US006858788B2

(12) United States Patent
Liao

(10) Patent No.: US 6,858,788 B2
(45) Date of Patent: Feb. 22, 2005

(54) ADJUSTABLE CYMBAL ASSEMBLY

(76) Inventor: Tsun-Chi Liao, 1F, No. 7, Lane 545, Sec. 2, Chun-Kung Rd., Taichung City (TW)

( * ) Notice: Subject to any disclaimer, the term of this patent is extended or adjusted under 35 U.S.C. 154(b) by 93 days.

(21) Appl. No.: 10/352,881

(22) Filed: Jan. 29, 2003

(65) Prior Publication Data

US 2004/0144234 A1 Jul. 29, 2004

(51) Int. Cl.[7] ..... G10D 13/02
(52) U.S. Cl. ..... 84/422.3; 84/327; 84/421
(58) Field of Search ..... 84/422.3, 327, 84/421

(56) References Cited

U.S. PATENT DOCUMENTS 4,381,690 A * 5/1983 Kimble ..... 84/422.3
5,063,819 A * 11/1991 Hoshino ..... 84/422.3
6,239,343 B1 * 5/2001 Hoshino ..... 84/422.3
6,417,434 B1 * 7/2002 Lao ..... 84/422.3

* cited by examiner

*Primary Examiner*—Shih-Yung Hsieh
(74) *Attorney, Agent, or Firm*—Birch, Stewart, Kolasch & Birch, LLP.

(57) ABSTRACT

An adjustable cymbal assembly comprises a vertical rod having an upper damper and a lower damper passing through its upper section, and a cymbal being coupled to the top of the vertical rod by a fixture; an adjusting unit passing through the vertical rod and disposed on the bottom of the lower damper and having a coupling member at the top of the adjusting unit to press downward to couple with the lower damper, and a rotary member and a brake member are installed with a screw to press against the coupling member, such that the cymbal can be adjusted to a desired tightness quickly without using a tool.

11 Claims, 4 Drawing Sheets

ADJUSTABLE CYMBAL ASSEMBLY

FIELD OF INVENTION

The present invention relates to an assembly for clipping a cymbal, more particularly to an adjustable cymbal assembly that can be clipped to a desired tightness quickly to obtain the expected sound effect without using a tool.

BACKGROUND OF THE INVENTION

Refer to FIG. 1 for a prior art cymbal adjusting assembly, comprising a rod 1 having a different diameter at its upper section and its lower section; a screw rod 2 disposed at the lower section of the rod 1 for securing a screw pipe 3, and a positioning member 4 passing through the top of the screw pipe 3 and then sheathing into a tubular body 5, and the tubular body 5 is vertically coupled to two dampers 6 for vertically clipping a cymbal 7, and a screw nut 8 at the top of the rod 1 being used for securing the cymbal and preventing it from being detached from the two dampers 6 to avoid the vibration caused by hitting the cymbal 7. The lower damper 6 pushing the screw tube 3 upward is gradually withdrawn downward, and the wall at the lower section of the screw tube 3 is secured transversally by a screw 9; one end of the screw 9 pressing tightly on the outer wall of the screw tube 3 to prevent the screw tube 3 from withdrawing downward from the rod 1 due to the vibration. However, such assembly requires the drummer to adjust the tightness of the cymbal 7 by using a wrench to loosen the screw 9 and withdraw the screw from the wall of the rod 1, and then rotate the screw tube 3 to move it up and down for adjusting the tightness of the cymbal, and thus obtain different sound effects by having different vibration amplitudes. Obviously, it is impractical to ask a drummer to carry a wrench all the time.

SUMMARY OF THE INVENTION

The primary objective of the present invention is to provide an adjustable cymbal assembly comprising: a vertical rod having an upper damper and a lower damper coupled to the upper section of the rod to clip a cymbal; a fixture at the top of the vertical rod being used to secure the cymbal and preventing the cymbal from being separated from the two dampers; an adjusting unit disposed at the bottom of the lower damper securing the vertical rod, so that the vertical rod will displace vertically to push the lower damper upward and adjust the tightness of clipping the cymbal quickly without using a tool. Such arrangement gives the expected sound effects when hitting the cymbal.

To provide a further understanding of the invention, the following detailed description illustrates embodiments and examples of the invention, this detailed description being provided only for illustration of the invention.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
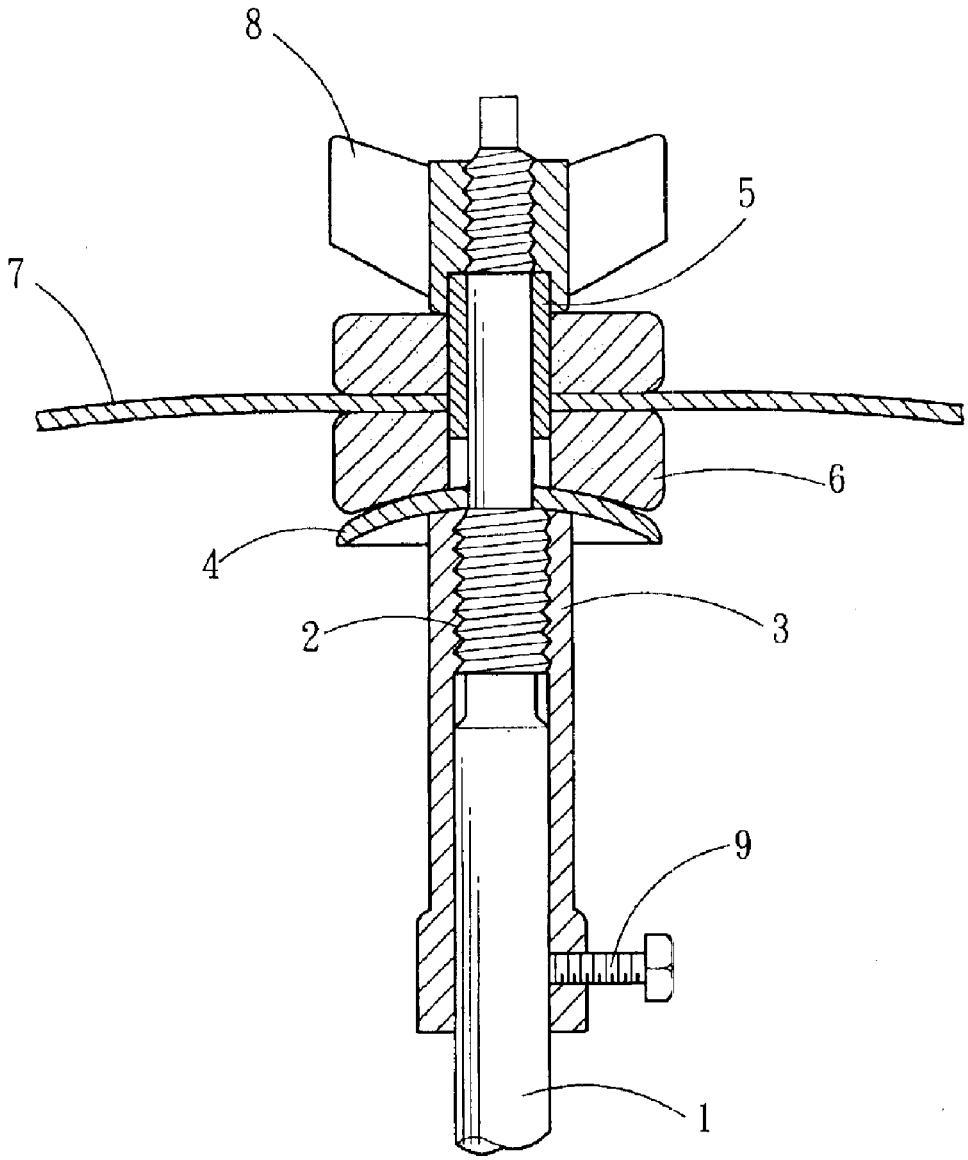
FIG . 1 PRIOR ART
FIG. 1 is a cross-sectional diagram of a prior art cymbal adjusting assembly.
Figure 2:
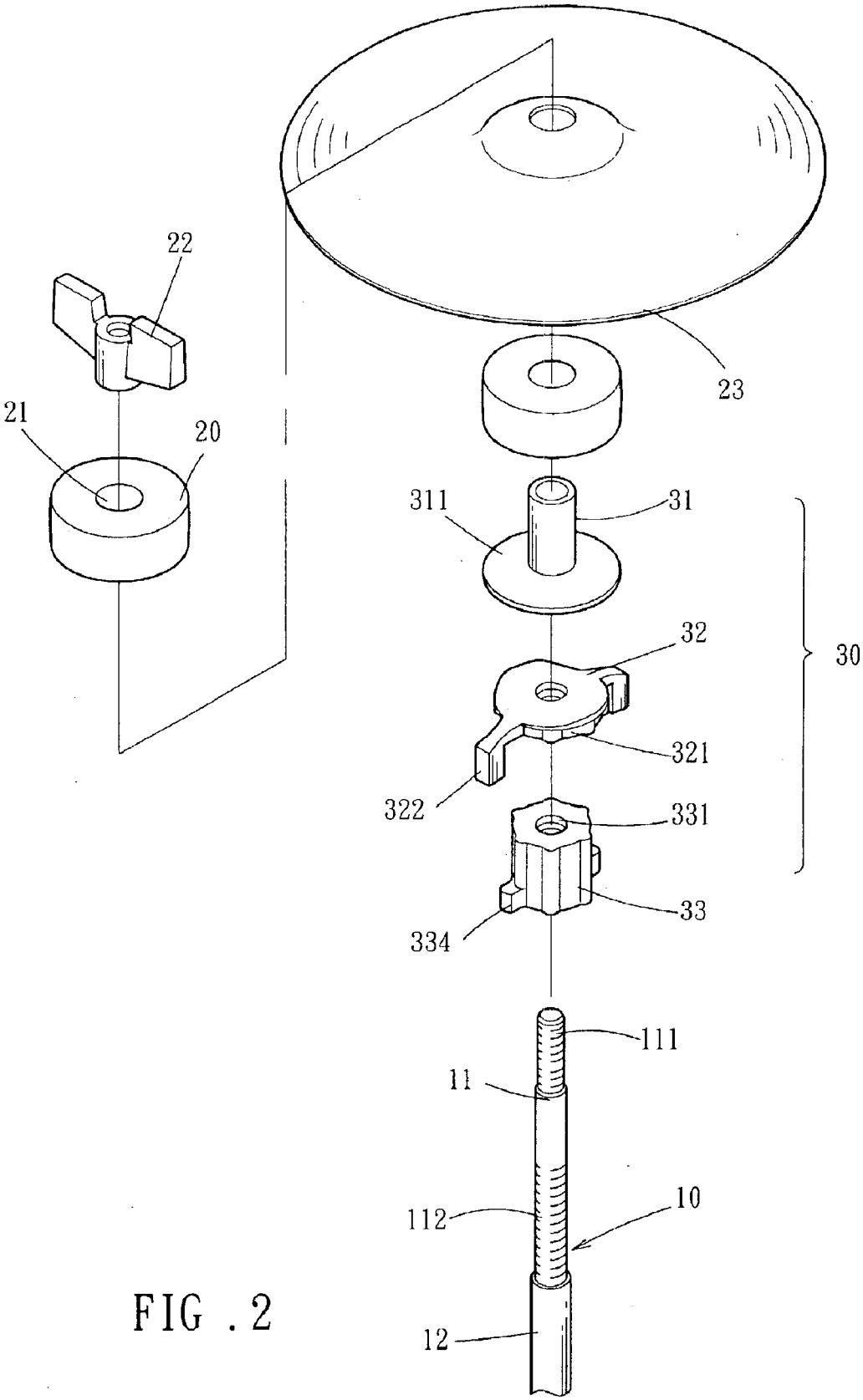
FIG. 2 is perspective diagram of the disassembled parts of a preferred embodiment of the present invention.
Figure 3:
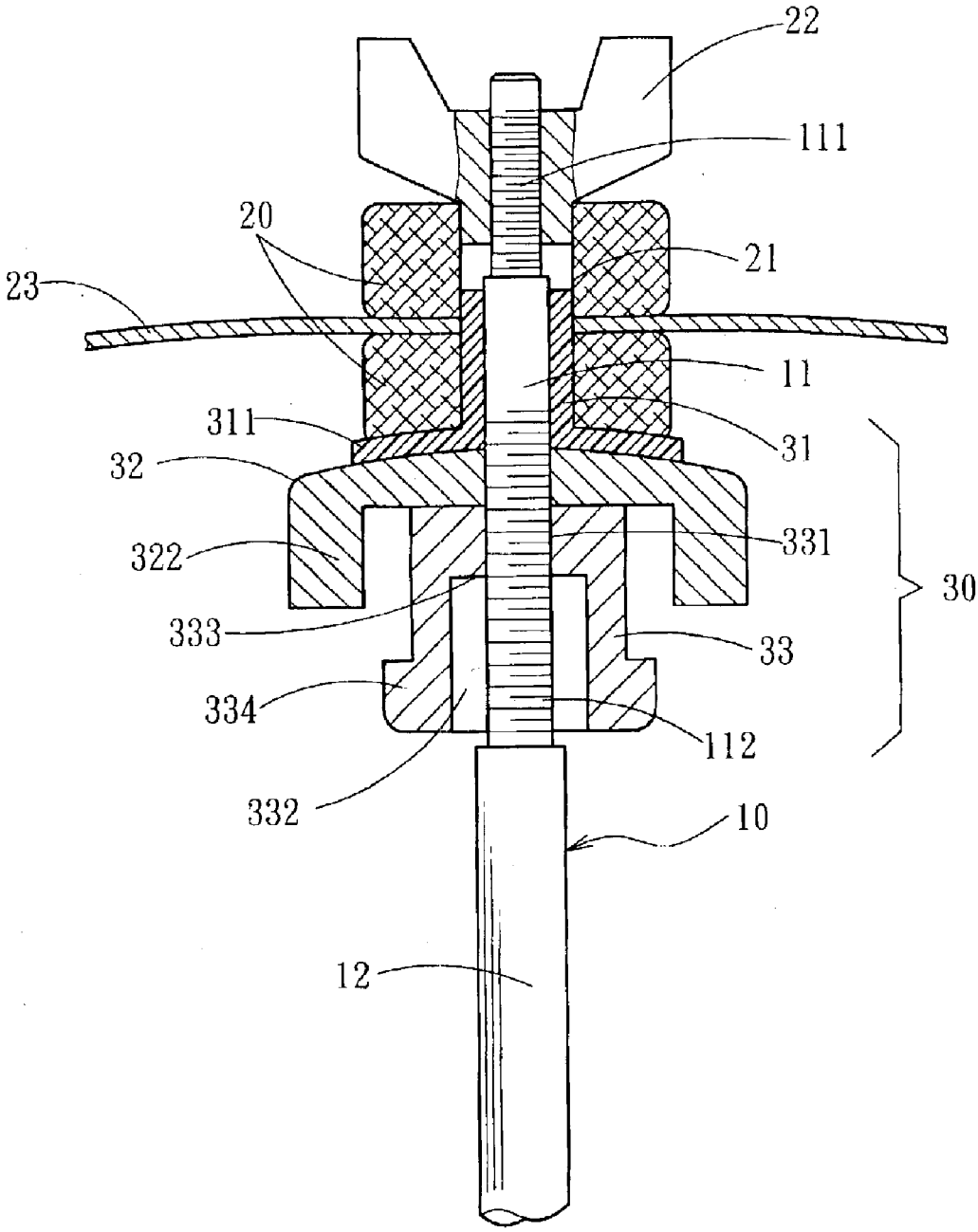
FIG. 3 is a cross-sectional diagram of a preferred embodiment of the present invention.

Refer to FIGS. 2 and 3 for the adjustable cymbal assembly of the present invention comprising:

A vertical rod 10, having a diameter at its upper section 11 smaller than that at a lower section of the vertical rod 10, a first screw rod 111 disposed at one end of the upper section 11, a second screw rod 112 disposed at the bottom of the upper section 11 of the vertical rod 10 proximate to the position of the lower section 12;

an upper and a lower dampers 20, being a vibration absorbing fiber material, and at its center having a central hole passing through the upper section 11 of the vertical rod 10, and working with a fixture 22 in a butterfly screw nut to mount the first screw rod 111 on the vertical rod 10 and vertically clip a cymbal 23;

an adjusting unit 30 passing through the vertical rod 10, being disposed at the bottom of the lower damper 20, comprising a hollow coupling member 31 passing through the upper section 11 of the vertical rod 10 in the axially downward direction, and the upper section of the coupling member 31 is in a tubular shape for letting the center of the lower damper 20 be surrounded by the outer periphery, a circular tapered supporting section 11 being extended outward from its bottom, and the area of the top surface of the supporting section 311 being larger than the area of the bottom surface of the lower damper 20;

a rotary member 32, having its central screw hole secured to the second screw rod 112 of the vertical rod 10 and disposed at the bottom of the coupling member 31, and the outer periphery of the rotary member has a slippery-resisting section with a plurality of corrugations to jointly hold the rotation, two wing sections 322 separately disposed on the corresponding periphery of the slippery-resisting section and extending downward to an appropriate length, and the front and rear surfaces each being an inwardly concave curved surface to fit the ergonomic requirements and comfort of holding;

a brake member 33, with its top center having a screw hole 331 for securing the brake member 33 on the second rod 112 of the upper section 11 of the vertical rod 10, a through hole 332 coupling the lower section 12 of the vertical rod 10, and a blocking edge 333 being defined by the interface surface of the screw hole 331 and the through hole 332 to press against the top surface of the lower section 12 of the vertical rod 10, and the brake member at its wall also having a corrugated slippery-resisting section wherein two corresponding protruded wings 334 are located on the wall at the bottom of the brake member 33 for locating the position of the brake member 33 by hand without looking at it.

Figure 4:
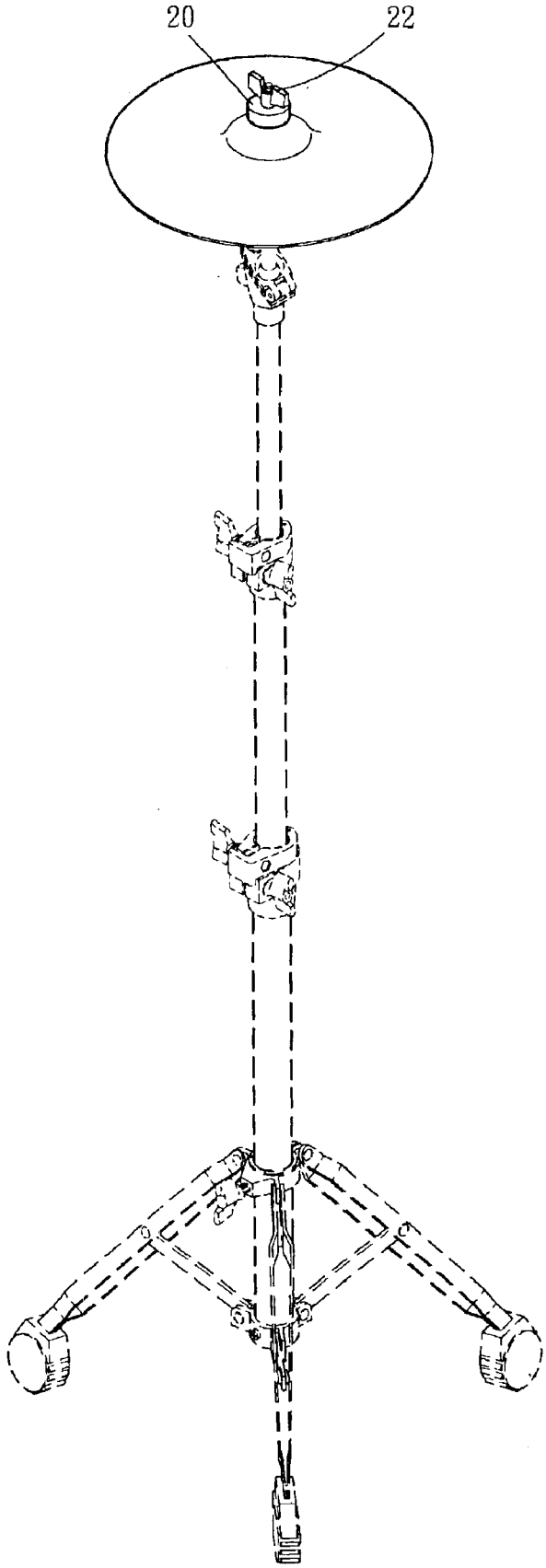
FIG. 4 is an illustrative diagram of the assembled cymbal of the present invention.

Please refer to FIG. 4. In the above structure, since the cymbal 23 by itself produces an effect of powerful rhythm when the hit-hat cymbal 23 is hit, and thus the tightness for clipping the cymbal 23 vertically is closely related to the sound effect of hitting the cymbal 23. The drummer may adjust such tightness for the cymbal 23 anytime according to different melodies, and adjust the sound effect by changing the vibration amplitude of the cymbal. During the operation, the drummer just needs to rotate the rotary member 32 in a clockwise or anti-clockwise direction by hand to move the rotary member 32 vertically. When the rotary member 32 is moving upward, it also pushes the lower damper 20 upward to press against the bottom of the cymbal, so that the cymbal is clipped tighter. The brake member 33 presses against the rotary member 32 to prevent the rotary member 32 from being loosened during the rotation.

On the other hand, if the drummer wants to loosen the tightness of clipping the cymbal 23, the drummer just needs to rotate the brake member 33 in the opposite direction to move the brake member 33 downward, and then rotate the rotary member 32 to move itself downward a little bit, and then rotate the brake member 33 tightly and fix the rotary member 32 in a predetermined position to avoid it from being withdrawn due to the vibration. Further, to fix the brake member 33 on the vertical rod 10 and prevent it from falling off during its downward rotation, a blocking edge 333 at the top of the through hole 332 of the brake member 33 is supported by the lower section 12 of the vertical rod 10. Such arrangement can prevent the brake member 33 from being separated from the vertical rod 10 or falling off.

The advantage of the present invention resides on the design of the rotary member 32 and the brake member 33, so that the drummer can manually adjust the tightness of clipping the cymbal in a quick manner without using a tool. Moreover, the coupling member 31 used for adjusting the vertical position of the rotary member 32 by spiral movements can have a fine tune effect.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An adjustable cymbal assembly, comprising:

a vertical rod, having an upper damper and a lower damper passing therethrough and a fixture jointly clipping a cymbal;

an adjusting unit, passing through said vertical rod and being disposed at a bottom of the lower damper, vertically displaceable to push against the lower damper and adjust the cymbal to a predetermined tightness without using a tool; and a rotary member secured on said vertical rod, the rotary member having a brake member at a bottom thereof, the brake member being secured on the vertical rod, said rotary member around an outer periphery thereof having a corrugated slippery-resisting section, and at least two wing sections being extended individually from the corresponding periphery of said slipper-resisting section, the two wing sections having a front surface and a rear surface composed of an inwardly concave curved section.

2. The adjustable cymbal assembly of claim 1, wherein said adjusting unit comprises a coupling member being coupled to the vertical rod, said coupling member supporting the bottom of the lower damper, the rotary member being disposed under said coupling member.

3. The adjustable cymbal assembly of claim 2, wherein said coupling member at a bottom thereof has a downwardly tapered circular supporting section to support the lower damper.

4. The adjustable cymbal assembly of claim 3, wherein said supporting section of the coupling member has a top surface larger than a bottom surface of the lower damper.

5. The adjustable cymbal assembly of claim 1, wherein the vertical rod has an upper section smaller than a lower section, and a screw hole disposed at a center of the top of the brake member to secure the upper section of the vertical rod, and said screw hole has a through hole larger than said screw hole for coupling the lower section of the vertical rod, and the brake member has a corrugated slippery-resisting section around a wall of the brake member.

6. The adjustable cymbal assembly of claim 5, wherein the slippery-resisting section of the brake member at the bottom wall has at least two corresponding protruded wings, and the outer side of said two protruded wings protrude from the periphery surface of said slippery-resisting section.

7. An adjustable cymbal assembly, comprising:

a vertical rod, having an upper damper and a lower damper passing therethrough and a fixture jointly clipping a cymbal;

an adjusting unit, passing through said vertical rod and being disposed at a bottom of the lower damper, vertically displaceable to push against the lower damper and adjust the cymbal to a predetermined tightness without using a tool; and a rotary member secured on said vertical rod, the rotary member having a brake member at a bottom thereof, the brake member being secured on the vertical rod, the vertical rod has an upper section smaller than a lower section, and a screw hole disposed at a center of the top of the brake member to secure the upper section of the vertical rod, and said screw hole has a through hole larger than said screw hole for coupling the lower section of the vertical rod, and the brake member has a corrugated slippery-resisting section around a wall of the brake member.

8. The adjustable cymbal assembly of claim 7, wherein the slippery-resisting section of the brake member at the bottom wall has at least two corresponding protruded wings, and the outer side of said two protruded wings protrude from the periphery surface of said slippery-resisting section.

9. The adjustable cymbal assembly of claim 7, wherein said adjusting unit comprises a coupling member being coupled to the vertical rod, said coupling member supporting the bottom of the lower damper, the rotary member being disposed under said coupling member.

10. The adjustable cymbal assembly of claim 9, wherein said coupling member at a bottom thereof has a downwardly tapered circular supporting section to support the lower damper.

11. The adjustable cymbal assembly of claim 10, wherein said supporting section of the coupling member has a top surface larger than a bottom surface of the lower damper.

* * * * *